United States Patent [19]

Bartolini et al.

[11] Patent Number: 4,760,698

[45] Date of Patent: Aug. 2, 1988

[54] STIRLING ENGINE

[75] Inventors: Carlo M. Bartolini, Senigallia; Vincenzo Naso; Ferdinando Suraci, both of Rome, all of Italy

[73] Assignee: Comitato Nazionale per la Ricerca e per lo Sviluppo del' Energia Nuclere e Delle Energie Alternative, Rome, Italy

[21] Appl. No.: 75,977

[22] Filed: Jul. 21, 1987

[51] Int. Cl.[4] ..... F02G 1/04

[52] U.S. Cl. ..... 60/526; 60/517

[58] Field of Search ..... 60/517, 525, 526

[56] References Cited

U.S. PATENT DOCUMENTS

| | | | |
|---|---|---|---|
| 3,751,904 | 8/1973 | Rydberg | 60/525 |
| 4,255,929 | 3/1981 | Frosch | 60/517 |

FOREIGN PATENT DOCUMENTS

| | | | |
|---|---|---|---|
| 0025317 | 3/1981 | European Pat. Off. . | |
| 926126 | 9/1947 | France . | |
| 1007422 | 5/1952 | France | 60/525 |
| 1307196 | 9/1962 | France . | |
| 1512768 | 2/1968 | France . | |
| 1549120 | 6/1979 | United Kingdom . | |

OTHER PUBLICATIONS

Japanese Patent Abstract, Document #61-226546, published 10/8/1986.

Japanese Patent Abstract, Document #58-167862, published 10/4/1983.

Japanese Patent Abstract, Document #60-69252, published 4/19/1985.

*Primary Examiner*—Stephen F. Husar

*Attorney, Agent, or Firm*—Fitzpatrick, Cella, Harper & Scinto

[57] ABSTRACT

A modified Stirling cycle engine is described in which an increase of efficiency is obtained by using the heat transferred by conduction from the walls of the expansion cylinder and the expansion piston and providing a labyrinth dynamic seal at least on the expansion piston.

4 Claims, 3 Drawing Sheets

STIRLING ENGINE

FIELD OF THE INVENTION

1. Background of the Invention

The present invention relates to a Stirling engine and more particularly to a modification of the Stirling cycle of the engine for increasing its efficiency.

A development of the Stirling engine has been hindered up to now by its reduced performance with respect to its high technological level and consequently its cost.

To increase the specific power renders necessary the use of too severe operating conditions, such as the use of particular materials to withstand high temperatures and pressures.

2. Description of the Prior Art

In this field particular approaches have been attempted by researchers, however these only belong to the double-acting category, which afford an increase of the specific power per weight and/or volume unit.

SUMMARY OF THE INVENTION

According to the present invention, using the heat transferred by conduction from the walls of the expansion cylinder and the expansion piston, and using a labyrinth dynamic seal on the expansion piston, such as to allow a seepage of the fluid between the inner wall of the cylinder and the outer wall of the piston, power is obtained from a Stirling cycle which is established at the lower side of the piston, so that a double acting Stirling engine is obtained with cycles facing one another and in communication, at different densities and temperatures.

Differently from the known conventional double-acting Stirling engines, in which two different and separate fluids each undergo a respective independent Stirling cycle, in the engine of the present invention a sole fluid undergoes an upper Stirling cycle which gives the main contribution to work production, as well as a lower Stirling cycle which gives a minor contribution to the work production, which however increases the total cycle efficiency by using normally dissipative effects which are positively utilized for heat recovery.

Consequently power is obtained from a cycle which is not directly heated, using however the thermal losses of the upper cycle.

This represents a first form of efficiency increase: namely to use a heat loss to obtain a low temperature recovery cycle.

A second form of efficiency increase consists in providing on the expansion piston a labyrinth dynamic seal which, in addition to providing a considerable advantage by eliminating the lubrication and wear problems, contributes to reducing the work losses due to friction and consequently to increase at the same time the reliability level of the engine.

The seal problem in fact is one of the most serious constraints to a positive development of Stirling engines.

Providing the dynamic seal varies, however, not only the engine structure, but its thermodynamic performance also. The labyrinth seal in fact realizes a pressure drop by the fact that a fluid stream is made to pass through gaps interposed between grooves in which the fluid can expand again, so producing a step by step pressure decrease.

As can be seen, however, this necessarily involves a mass transfer.

The provision of such a sealing system in a double-acting closed cycle will lead to an alternated mass transfer between the two cycles. However, as the engine of the invention operates with the two cycles at a different mean temperature, a different mean operating pressure will be developed and consequently a cyclic loss of mass will be directed from the upper to the lower cycle until a balance rate will be reached. On reaching this rate, a very small transfer of mass between the two cycles will be had, able to produce the same amount of work, in that they operate at the same effective mean pressure, being however characterized by different temperatures and consequently different mean densities.

The invention provides an improved Stirling engine, having an expansion piston and a compression piston sliding into respective cylinders and defining an upper side and a lower side therein, a heater and a cooler on the upper side of said cylinders, and a regenerator in communication between said heater and cooler, comprising:

a piston rod integral with each piston and moving coaxially to the cylinder axis;

a bottom on the lower side of each cylinder for forming respective lower chambers, said rods being slidingly and sealingly engaged through said bottoms;

labyrinth dynamic seals formed on said expansion piston, for allowing a seepage of fluid from the upper to the lower side of said cylinder, whereby by means of absorbtion by said fluid in said lower side of the cylinder, of the heat transferred by conduction from the walls of said cylinder and said expansion piston, a lower Stirling cycle is established in said lower chambers, which produces a double-action effect with heat recovery and work production; and a second regeneration in communication with said two lower chambers.

An engine of highly simplified structure is thus obtained, having an upper cycle at a high temperature and a low density and a lower cycle at a low temperature and high density.

BRIEF DESCRIPTION OF THE DRAWINGS

The present invention will be better illustrated hereinafter by a description of embodiments thereof, given as non-limitative examples, with reference to the accompanying drawings, in which.

DESCRIPTION OF THE PREFERRED EMBODIMENT

Figure 1:
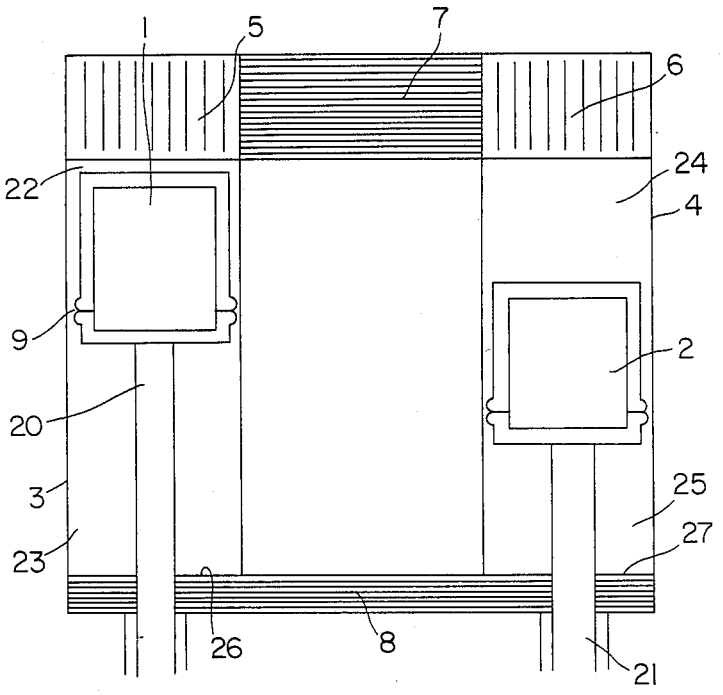
FIG. 1 is a schematic view, in a cross-section, of a Stirling engine according to the invention.

Referring to FIG. 1, in which a Stirling engine of the present invention is schematically illustrated, in a configuration with two cylinders in line, the expansion piston and the compression piston are indicated in 1 and 2 respectively, which slide into cylinder 3 and 4 respectively.

On the upper end of the cylinder 3 and in communication with the interior thereof, a heater 5 is placed for heating the fluid in the upper cycle, whereas above the cylinder 4 and in communication through the interior thereof, a cooler 6 is placed for cooling the fluid in the upper cycle. Between the heater 5 and the cooler 6, in communication with both, an upper cycle regenerator 7 is placed.

On the lower end of the cylinders 3 and 4 a lower cycle regenerator 8 is placed.

From the foregoing it will be noted that the expansion and compression pistons 1, 2 define within the respective cylinders 3, 4 an upper side 22, 24 and a lower side 23, 25 respectively.

The lower sides or lower chambers 23, 25 are closed at their lower ends by bottoms 26, 27 through which piston rods 20, 21 of the expansion and compression pistons 1, 2 are sealingly and slidingly engaged.

The fluid within the upper sides 22, 24 undergoes a Stirling cycle at a high temperature and a low density, whereas the fluid in the lower sides 23, 25 undergoes a Stirling cycle at a low temperature and a high density.

The expansion and compression pistons 1 and 2 are provided with labyrinth seals, only one of which is schematically shown and indicated with 9, the main feature of which consists in the fact of having no contact with the parts in relative motion, thus allowing a seepage of fluid from the upper to the lower cycle. In operation, the fluid passing through the labyrinth dynamic seals 9 from the upper side to the lower side of the engine, absorbs the heat transferred by conduction from the walls of the cylinder 3 and the expansion piston 1, so that a lower Stirling cycle is established having a double-acting effect. This represents a recovery of the heat produced by the heater 5 which is transformed into a work increase and which would be lost in a conventional Stirling engine.

Figure 2:
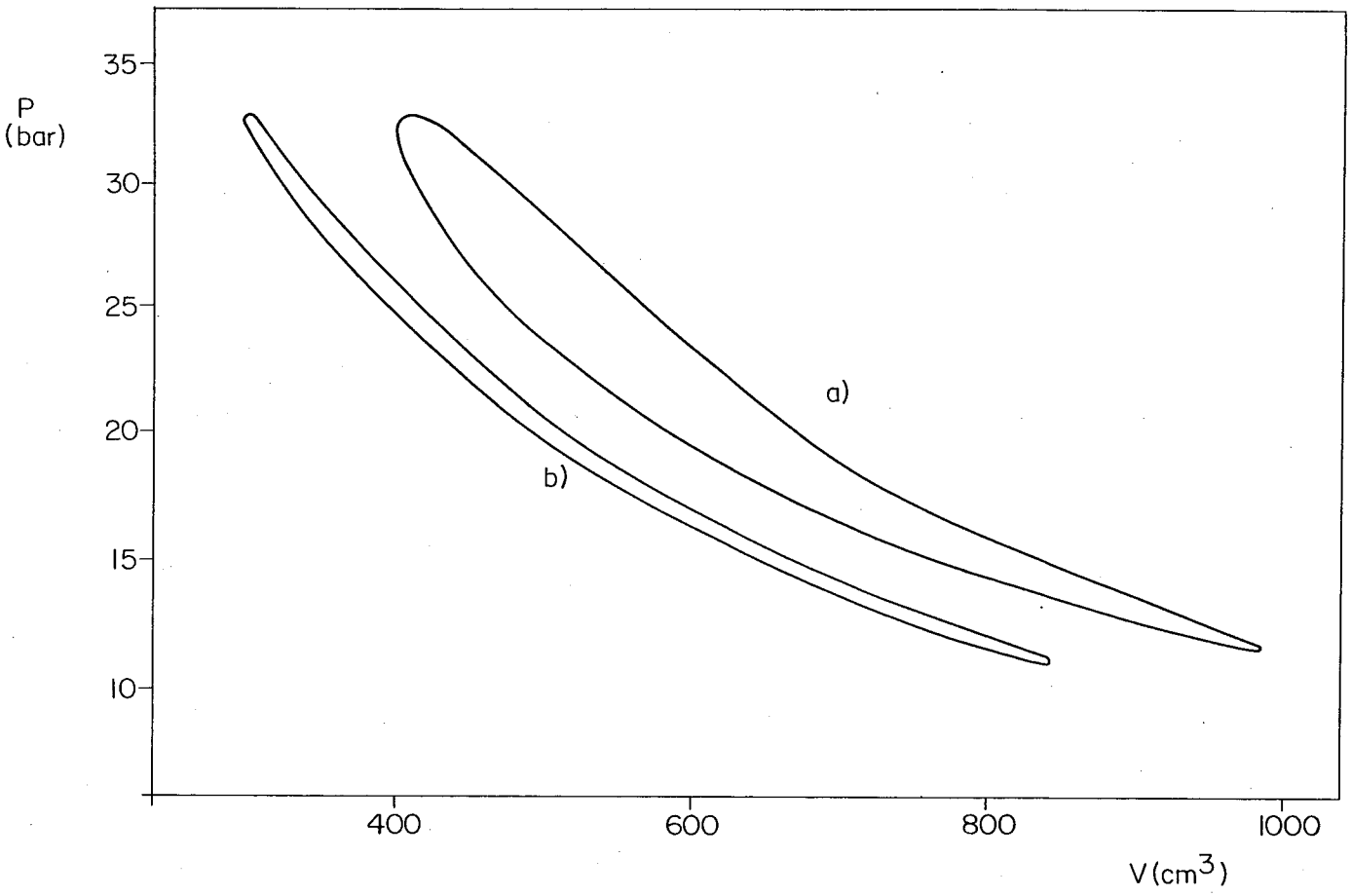
FIG. 2 is a diagram of the total cycle realized with the Stirling engine of the invention.

A diagram of the effective cycle of the engine according to the invention was plotted from measurements, expressed as pressure and volume parameters, shown in FIG. 2.

As can be observed from the FIGURE the total cycle is divided into a main upper cycle (a), established by heating the fluid by means of the said heat source, and a lower cycle (b) which encircles a smaller area, established by the recovery of heat transferred by conduction from the walls of the expansion cylinder and the expansion piston, as effected by the fluid passed through the labyrinth dynamic seals provided on the expansion piston.

In the above illustrated scheme of the double-acting Stirling engine having cycles facing one another and in communication at different densities and temperatures, the geometrical features of the expansion piston have basic importance in order to meet the following requirements:

to be able to house labyrinth dynamic seals of peculiar profile and in a number suitable to the specific operating field of the engine (depending on the operating fluid, operating speed, working pressures, high temperature of cycle, materials used and so on);

reduction of the weight of the reciprocating mass;

a longitudinal size of the pistons sufficient to separate the two operating areas at different temperatures with the typical function of a displacer.

Figure 3:
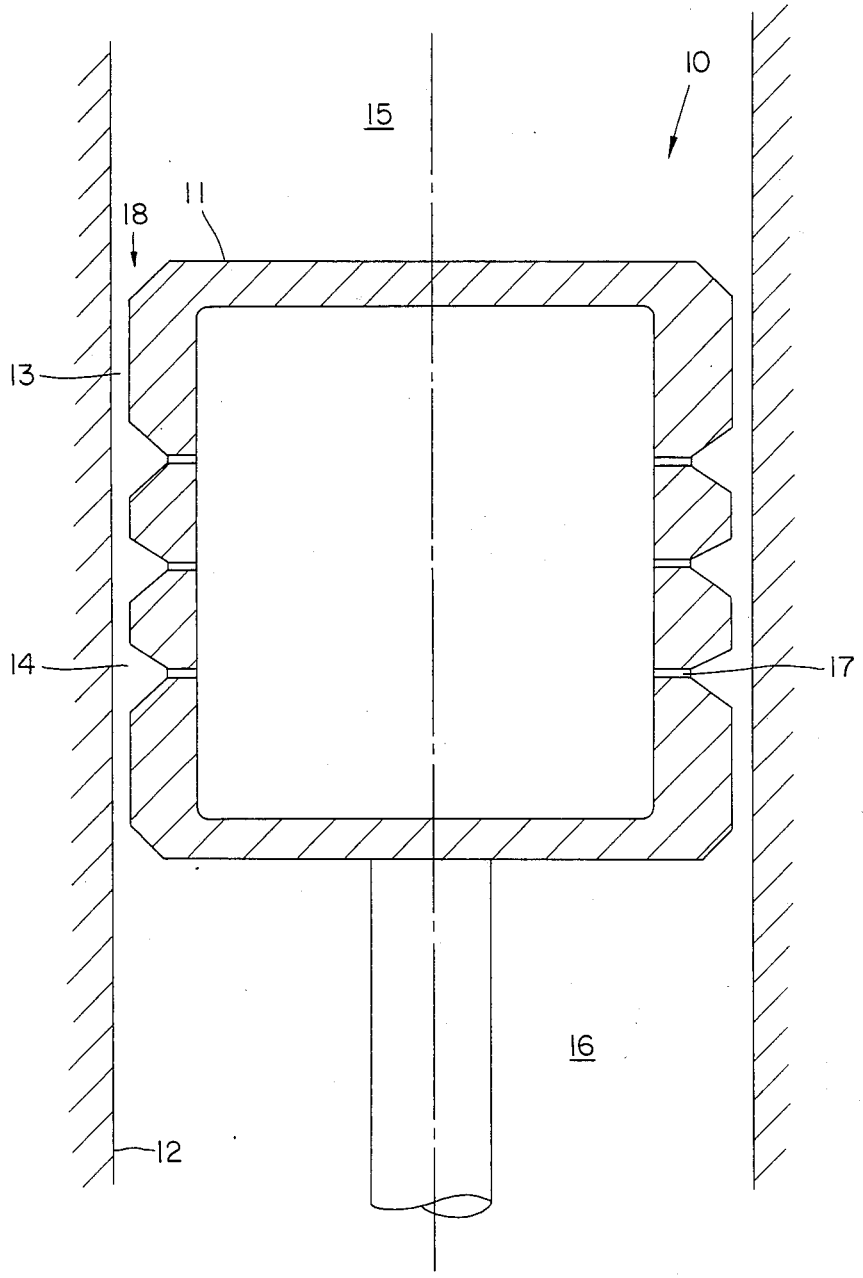
FIG. 3 is a cross section schematic view of a type of piston to be used in the Stirling engine of the invention.

FIG. 3 shows an embodiment of the piston, generally indicated with 10, to be used in a Stirling engine of the present invention, which meets the abovementioned requirements.

The piston 10 is formed as a hollow cylindrical body 11 slidingly engaged with a cylinder 12.

On the peripheral outer surface of piston 10 labyrinth dynamic seals 18 are provided substantially formed with an alternated succession of gaps 13 and annular chambers 14 conformed as triangular grooves which serve the purpose of causing the fluid to follow a sinuous path between two spaces at different pressures, particularly the expansion space of the upper cycle, indicated in 15, and the expansion space of the lower cycle, indicated in 16, so as to obtain the dissipation of energy necessary to cause a pressure drop. In fact, in the gaps a portion of the pressure energy of the fluid is converted into kinetic energy and in the subsequent cavities such kinetic energy is dissipated by friction into the fluid. This process, repeated in series, gives rise to a pressure drop and a sealing.

Radial bores 17 are provided in the bottom of the annular chambers 14 and are calibrated for the balance of the inner and outer static pressures of the piston 10, so as to make it able to withstand the stresses to which it is subjected.

The present invention is not restricted to the illustrated embodiments, and comprises any modification thereof.

What is claimed is:

1. Improved Stirling engine, having an expansion piston and a compression piston sliding into respective cylinders and defining an upper side and a lower side therein, a heater and a cooler on the upper side of said cylinders, and a regenerator in communication between said heater and cooler, comprising:

a piston rod integral with each piston and moving coaxially to the cylinder axis;

a bottom on the lower side of each cylinder for forming respective lower chambers, said rods being slidingly and sealingly engaged through said bottoms;

labyrinth dynamic seals formed on said expansion piston, for allowing a seepage of fluid from the upper to the lower side of said cylinder, whereby by means of absorbtion by said fluid in said lower side of the cylinder, of the heat transferred by conduction from the walls of said cylinder and said expansion piston, a lower Stirling cycle is established in said lower chambers, which produces a double-action effect with heat recovery and work production; and a second regenerator in communication with said two lower chambers.

2. Stirling engine according to claim 1, in which said labyrinth dynamic seals comprise an alternated succession of gaps and grooves.

3. Stirling engine according to claim 1, in which said pistons comprise hollow cylindrical bodies in which calibrated radial bores are provided for balancing the inner and outer static pressure.

4. Stirling engine according to claim 2, in which said pistons comprise hollow cylindrical bodies in which calibrated radial bores are provided for balancing the inner and outer static pressure.

* * * * *

UNITED STATES PATENT AND TRADEMARK OFFICE

CERTIFICATE OF CORRECTION

PATENT NO. : 4,760,698

DATED : August 2, 1988

INVENTOR(S) : CARLO M. BARTOLINI, VINCENZO NASO and FERDINANDO SURACI

It is certified that error appears in the above-identified patent and that said Letters Patent is hereby corrected as shown below:

Title page, [73] Assignee: "Nuclere" should read -- Nucleare --.

Column 1, line 43, "efficiencly" should read -- efficiency --;

Column 2, line 31, "absorbtion" should read -- absorption --;
line 37, "regeneration" should read -- regenerator --;
line 62, "cylinder" should read -- cylinders --.

Column 4, line 11, "in" should read -- by --;
line 12, "in" should read -- by --;
line 44, "absorbtion" should read -- absorption --.

Signed and Sealed this

Fifth Day of May, 1992

*Attest:*

DOUGLAS B. COMER

*Attesting Officer*

*Acting Commissioner of Patents and Trademarks*